US009941594B2

(12) United States Patent
Milroy

(10) Patent No.: US 9,941,594 B2
(45) Date of Patent: Apr. 10, 2018

(54) INSCRIBED POLARIZER ARRAY FOR POLARIZATION DIVERSE APPLICATION

(71) Applicant: ThinKom Solutions, Inc., Torrance, CA (US)

(72) Inventor: William Milroy, Torrance, CA (US)

(73) Assignee: THINKOM SOLUTIONS, INC., Torrance, CA (US)

( * ) Notice: Subject to any disclaimer, the term of this patent is extended or adjusted under 35 U.S.C. 154(b) by 254 days.

(21) Appl. No.: 14/567,594

(22) Filed: Dec. 11, 2014

(65) Prior Publication Data

US 2016/0172766 A1 Jun. 16, 2016

(51) Int. Cl.
*H01Q 15/24* (2006.01)

(52) U.S. Cl.
CPC ..... *H01Q 15/242* (2013.01); *H01Q 15/244* (2013.01); *H01Q 15/246* (2013.01)

(58) Field of Classification Search
CPC ..... H01Q 15/242; H01Q 15/244
USPC ..... 343/753, 754, 756, 759, 766
See application file for complete search history.

(56) References Cited

U.S. PATENT DOCUMENTS 8,339,326 B2 * 12/2012 Guler ..... H01Q 15/244 343/754
2008/0291101 A1 * 11/2008 Braunstein ..... H01Q 3/02 343/754

FOREIGN PATENT DOCUMENTS

WO 2010/048174 4/2010

OTHER PUBLICATIONS

European Search Report for corresponding application No. 15199288.0 dated Apr. 22, 2016.

* cited by examiner

*Primary Examiner* — Dameon E Levi
*Assistant Examiner* — Hasan Islam
(74) *Attorney, Agent, or Firm* — Renner, Otto, Boisselle & Sklar, LLP.

(57) ABSTRACT

An antenna system includes an antenna having an aperture, and a polarizer array. The polarizer array includes a support structure, at least two polarizer elements arranged relative to the support structure, each of the at least two polarizer elements rotatable about a separate axis, and an actuator coupled to the at least two polarizer elements, the actuator operative to effect common rotation of the at least two polarizer elements. The polarizer array is arranged to at least partially cover the antenna aperture.

27 Claims, 9 Drawing Sheets

Fig. 4a - Tear Drop Shaped Polarizer Elements

Fig. 4b - Over-sized Polarizer Elements

Fig. 4c - Dissimilar Polarizer Elements (with tapered aperture distribution)

Polarizer Axial Ratio performance with different array coverage amounts

Gain performance with different polarizer coverage amounts

INSCRIBED POLARIZER ARRAY FOR POLARIZATION DIVERSE APPLICATION

TECHNICAL FIELD

The present disclosure relates generally to antenna arrays and, more particularly, to an apparatus and method for altering the polarization of an antenna array to support specific communications or radar applications for which there is a need to quickly change the intrinsic polarization of the antenna from one polarization sense (such as vertical or right-hand circular) to another (such as horizontal or left-hand circular).

BACKGROUND

To support full-duplex, 2-way communication, many satellite communications applications require that a particular satellite link use a specific combination of frequency band and polarization for the transmit portion of the link and a different combination of frequency band and polarization for the receive portion of the link. Additionally, satellite communications applications may require that the polarizations for each distinct band be periodically changed or switched to support oppositely polarized satellite transponders, or to counteract ("track-out") relative changes in polarization that may occur as a result of antenna orientation or geo-location. Earth station antennas used in airborne operations that operate in the Ka communications band, for instance, typically need to be capable of switching from Right Hand Circular polarization to Left Hand Circular polarization with little or no input from the operator.

A typical method for switching the circular polarization of a Ka-band antenna is to bring the circularly polarized transmit and receive signals to the back of the array, and then switch the polarization to the opposite sense using a polarization switch (which tends to be expensive and bulky). Another method of switching polarization is to physically "flip" a polarizer mounted on the face of the planar array antenna. However, a substantial increase in package volume is required to support such approach.

A common practice for altering the polarization of linear polarized reflector antennas is to physically rotate a dual linear polarized horn antenna that is used to feed such reflector antennas, rotating polarization in the process. However these types of antennas are bulky and exhibit poor efficiency when required to fit in limited volumes such as under radomes mounted on ground vehicles or aircraft. Planar antennas on the other hand, can be made with more extreme aspect ratios (length vs. height) to support such packaging challenges. A common practice of rotating the linear polarization of this type of antenna is achieved via the use of an Orthomode Transducer (OMT). In the case of circularly polarized antennas and some linear polarized antennas, a separate polarization switch is often employed to rotate one sense of circular to the other (e.g., left hand circular to right hand circular). Both approaches, however, have their drawbacks since OMT's and polarization switches tend to be large in size, heavy, expensive, and in many cases, suffer from high ohmic losses.

Another method of switching circular polarization (CP) is to physically "flip" a low-loss linear-to-CP polarizer mounted on the face of the planar array antenna. However, a substantial increase in package volume is required to support such an approach.

SUMMARY OF INVENTION

An inscribed polarizer array in accordance with the present disclosure includes one or more polarizing elements rotatable about an axis, and an actuator coupled to the one or more polarizing elements to effect common rotation of the polarizing elements. The one or more polarization elements can have, for example, a circular shape, a tear drop, or other shapes. The polarizer array is configured for placement relative to a planar radiating aperture to at least partially cover the aperture, thereby inscribing the planar area of the aperture. The polarizing array enables change of a polarization state of energy incident on the aperture, while providing a lower cost, light weight, compact device that can effect polarization changes. An advantage of the inscribed polarizer is that it provides increased ohmic efficiency, as losses associated with the OMT or switch are removed as a contributor to poor ohmic efficiency. Further, the requisite planar array feed structure can in many cases be greatly simplified to further improve array efficiency.

For example, an antenna system may include one or more polarizers that remain co-planar (or close to coplanar) to a rectangular (non-circular) antenna aperture, the one or more polarizers rotatable around one or more axes normal, or close to normal, relative to the rectilinear planar aperture surface. Such geometry may result in "interstitial" uncovered gaps between the rotating polarizers.

In one embodiment, a single-axis polarizer may include a single circular polarizer inscribed (i.e. not fully covering) a square aperture. Due to the different geometries between the aperture and polarizer, "interstitial" uncovered gaps (e.g., uncovered corners of the square) result. In another embodiment, an antenna system may include two or more coplanar (side-by-side) polarizers that inscribe the antenna aperture.

According to one aspect of the invention, an antenna system includes: an antenna having an aperture; and a polarizer array comprising a support structure, at least two polarizer elements arranged relative to the support structure, each of the at least two polarizer elements rotatable about a separate axis, and an actuator coupled to the at least two polarizer elements, the actuator operative to effect common rotation of the at least two polarizer elements, wherein the polarizer array is arranged to at least partially cover the antenna aperture.

In one embodiment, the at least two polarizer elements comprise dissimilar polarizer elements.

In one embodiment, the at least two polarizer elements have different dimensions from one another.

In one embodiment, an area of one of the at least two polarizer elements is different from an area of another of the at least two polarizer elements.

In one embodiment, the at least two polarizer elements comprise circular characteristics.

In one embodiment, the at least two polarizer elements comprise a tear drop shape or a circular shape.

In one embodiment, the actuator effects ganged mechanical rotation of the at least two polarizer elements.

In one embodiment, the actuator comprises at least one of a DC brushless motor, a stepper motor, a timing belt, a chain drive or a gear drive.

In one embodiment, the at least two polarizers comprise a linear-to-circular polarization polarizer or a dichroic linear-to-circular polarization polarizer.

In one embodiment, the at least two polarizers are configured to effect a switching of one sense of circular polarization to another sense of circular polarization.

In one embodiment, the at least two polarizers are configured to effect a twisting of one sense of linear polarization to another sense of linear polarization.

In one embodiment, the at least two polarizers comprise a twist polarizer operative to change a linearly-polarized wave polarized in a first direction to a linearly-polarized wave polarized in a second direction different from the first direction.

In one embodiment, the at least two polarizers comprise meanderline polarizers operative to convert a polarized wave to a circular polarized wave.

In one embodiment, the common rotation comprises synchronized rotation.

In one embodiment, the polarizer array includes a support structure, wherein the at least two polarizer elements mounted on the support structure.

In one embodiment, each polarizer element of the at least two polarizer elements is rotatable about a center axis of the respective polarizer element.

In one embodiment, the non-circular antenna comprises a planar antenna.

In one embodiment, the antenna aperture comprises a prescribed area, and the at least two polarizing elements extend outside the prescribed area.

In one embodiment, the antenna aperture is tapered in a predetermined plane of the planar antenna.

In one embodiment, the antenna system includes a transceiver communicatively coupled to the antenna aperture.

In one embodiment, the at least two polarizers cover at least 83 percent of the surface area of the antenna aperture.

In one embodiment, the antenna system includes inserts placed in interstitial regions on the antenna aperture, the inserts configured to match an insertion phase of the at least two polarizers.

In one embodiment, the antenna aperture has a non-circular shape.

In one embodiment, the antenna aperture has a rectangular shape.

In one embodiment, the at least two polarizers are co-planar.

According to one aspect of the invention, an antenna system includes: an antenna including an aperture having a first geometry; and a polarizer array comprising a support structure, at least one polarizer element arranged relative to the support structure, the at least one polarizer element having a second geometry different from the first geometry and rotatable about an axis, and an actuator coupled to the at least one polarizer element, the actuator operative to effect rotation of the at least one polarizer element, wherein the polarizer array is arranged relative to the antenna aperture such that at least a portion of the antenna aperture is uncovered by the at least one polarizer.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

DETAILED DESCRIPTION OF INVENTION

Planar antenna systems, which have all elements (both active and passive) in one plane, are often required to fit into relatively small spaces while maintaining key performance characteristics, including high ohmic efficiency and broad band operation. To achieve such performance and still provide polarization diversity in a compact package, a polarization scheme has been devised whereby two or more polarizers (e.g., polarizers having circular characteristics, such as circular polarizers, tear drop polarizers, and the like), each capable of mechanical rotation, are employed to partially cover a fixed/staring rectangular planar array antenna aperture, inscribing the array's rectangular area. The simple rotation of these polarizers on the face of the array can either effect the switching of one sense of circular polarization to another or the twisting and alignment of one sense of linear polarization to another, obviating the need for a heavy and expensive polarization switch or orthomode transducer, and in the process potentially simplifying the internal complexity of the array.

The inscribed polarizer array in accordance with the present disclosure allows for single-polarized planar array antennas to perform polarization functions that generally require more complicated and more expensive dual-polarized planar array antennas. Further, the inscribed polarizer array enables added functionality when applied to dual-polarized arrays via the addition of tracking linear (V/H and H/V) and switchable circular (RHCP/LHCP, LHCP/RHCP) polarization flexibility, without added microwave polarization control components.

As used herein, the term "inscribe" is defined as to not fully cover an area of an object. For example, if a shape (e.g., a first planar shape) is overlaid on a second shape (e.g., a second planar shape), the first shape inscribes the second shape when at least a portion of the second shape is uncovered (exposed) by the first shape).

Figure 1:
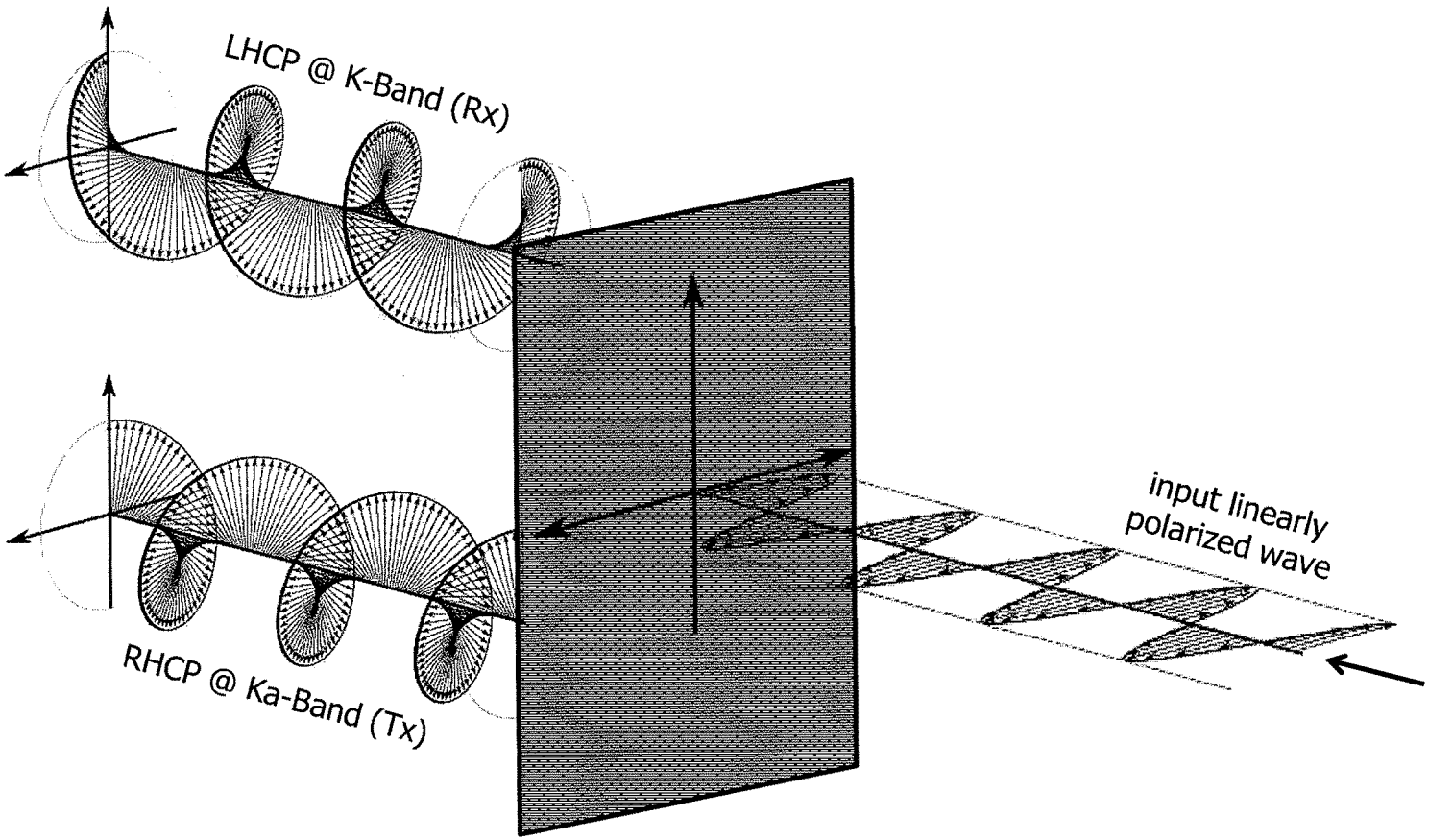
FIG. 1 is a functional diagram of an exemplary polarizer that may be used in an inscribed polarizer array in accordance with the present disclosure.

Polarizers can take on many forms and functions. In frequency spectrums where linear polarization dominates (i.e., Ku-Band), a commonly used polarizer is the twist polarizer, which takes an linearly-polarized input wave that is polarized in one direction and twists it to a differently oriented (but still linear) polarization. Another type of polarizer is the meanderline polarizer as shown in FIG. 1, which converts an input polarized input wave to circular polarization.

Figure 2:
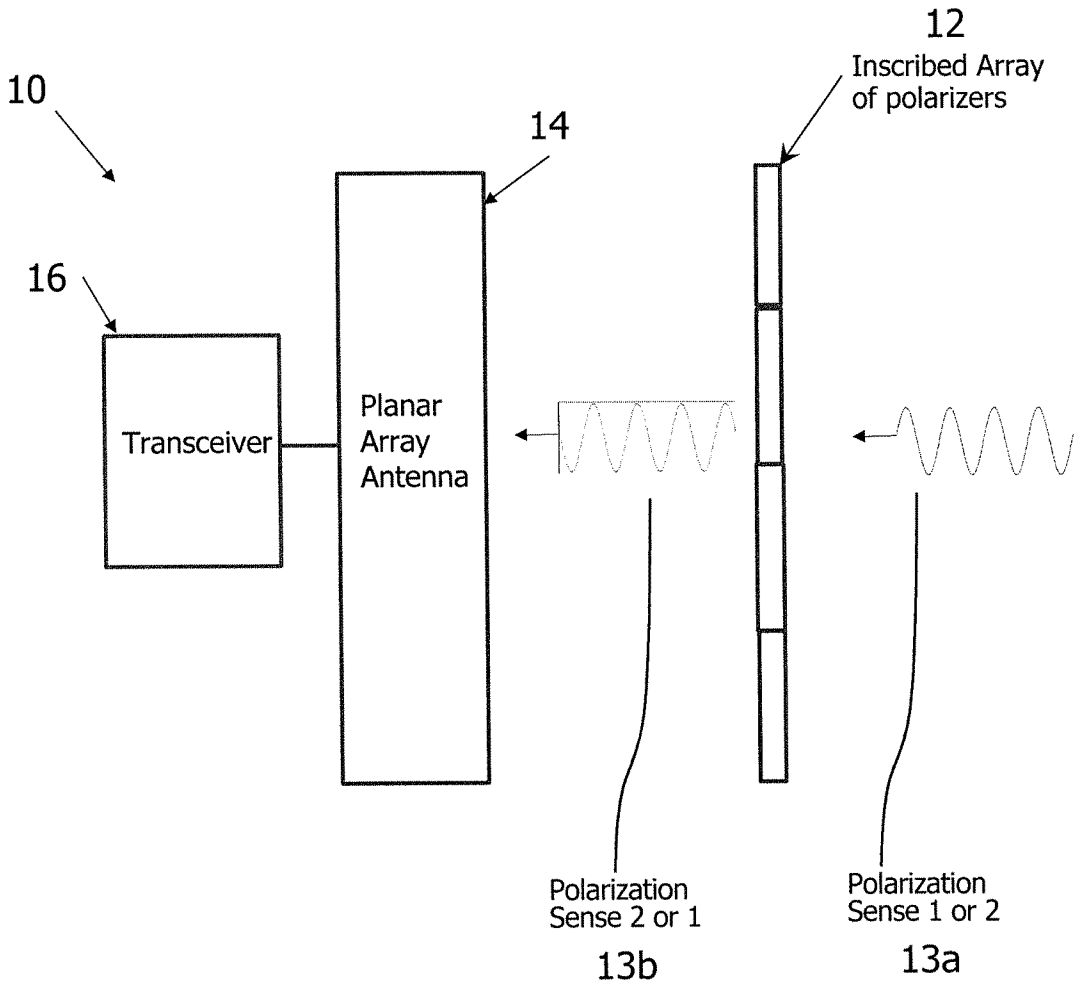
FIG. 2 is a block diagram of an exemplary inscribed polarizer array in accordance with the present disclosure.

Referring now to FIG. 2, illustrated is a block diagram of an exemplary inscribed polarizer array 10 in accordance with the present disclosure. The inscribed polarizer array 10 includes two or more polarizers 12 (i.e., a polarizer array), such as circular polarizers, that are configured for "ganged" mechanical rotation, e.g., synchronized rotation about an axis, such as a center axis or axis of symetry. The circular polarizers 12, which convert a signal from a first polarization sense 13*a* to a second polarization sense 13*b*, are located just in front of a planar array antenna 14 in which polarization is to be either continuously changed (in the case of tracking linear polarization for Ku-band SATCOM applications) or switched from one polarization state to another (in the case of circular polarization for Ka-band SATCOM applications). The planar array antenna 14 feeds a signal to a transceiver 16 for signal processing.

The approach illustrated in FIG. 2 in which the polarizers only partially cover the array antenna is counter-intuitive to conventional thinking. More specifically, one having ordinary skill in the art would expect that the configuration shown in FIG. 2 (i.e., where portions of the antenna array are uncovered by the polarizer) would produce unacceptable gain loss and cross-pol. Contrary to such thinking, the partial coverage provided by the inscribed polarizer yields excellent gain and cross-pol performance, despite the uncovered areas of the antenna array.

Figure 3A:
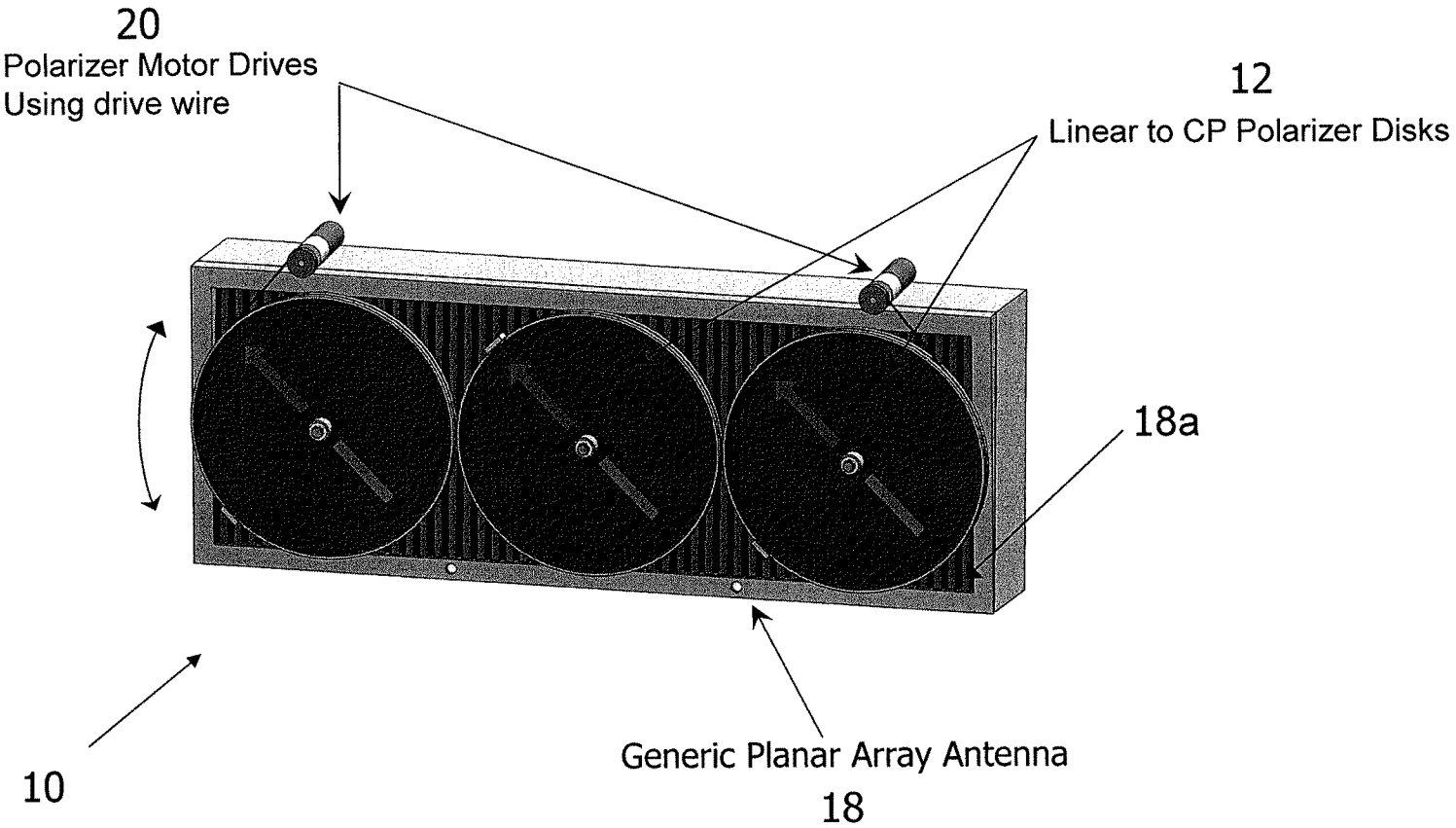
FIG. 3*a* is a perspective view of a generic planar antenna array employing an inscribed polarizer in accordance with the present disclosure.
Figure 3B:
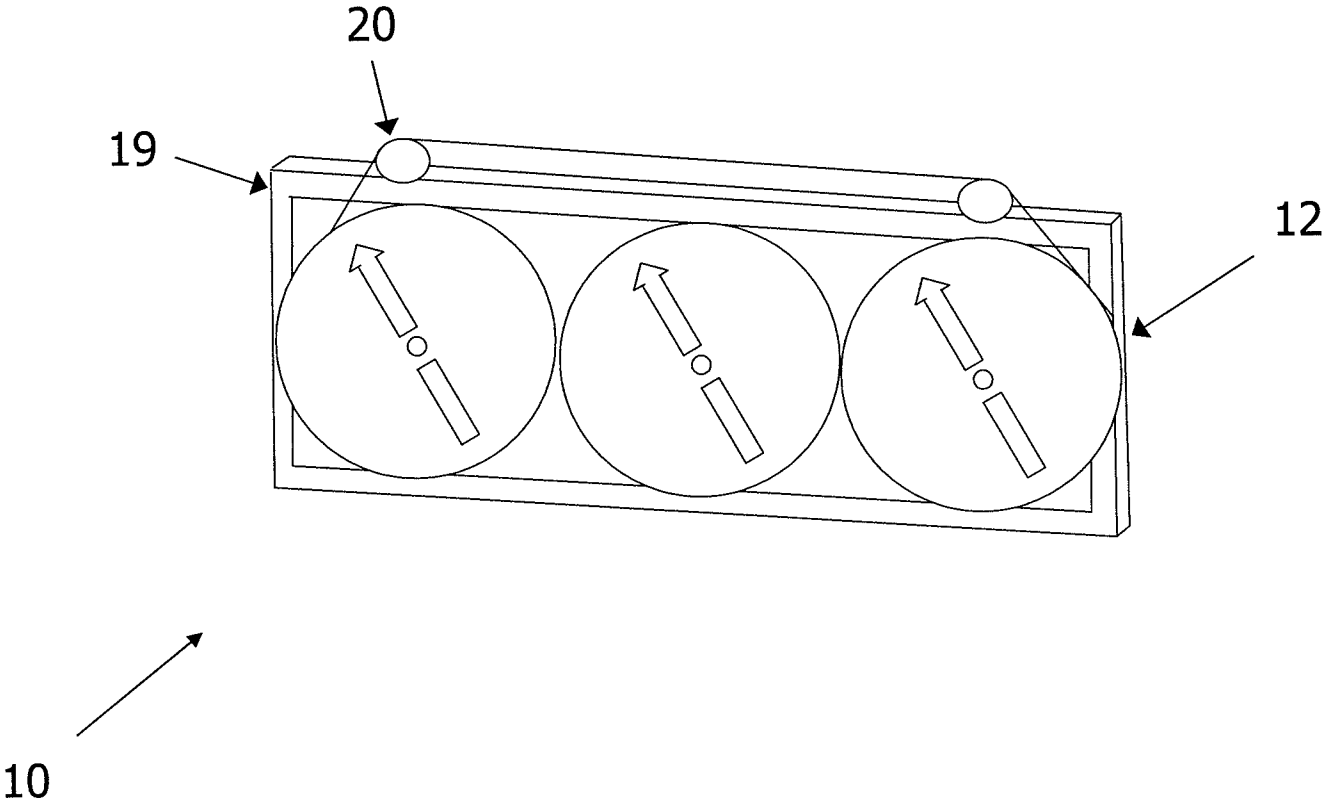
FIG. 3*b* is a perspective view showing the inscribed polarizer and support structure in accordance with the present disclosure.

With additional reference to FIGS. 3*a* and 3*b*, a front perspective view of an exemplary inscribed polarizer array 10 in accordance with the present disclosure is illustrated. In the exemplary polarizer array 10 circular meanderline polarizers 12 are employed to (partially) cover a (fixed/staring) rectangular planar array aperture 18*a* of a planar antenna array 18, "inscribing" the rectangular area. The polarizer array 10 may include a support structure 19 (FIG. 3B) to which at least two polarizer elements 12 may be mounted. Alternatively, the at least two polarizer elements 12 may be directly mounted on a support structure of a planar antenna 18 as shown in FIG. 3*a*.

One or more actuators 20, such as a motor (e.g., a DC brushless motor), are operatively coupled to the polarizers 12 to effect ganged rotation thereof. The actuator 20 may be mounted to the support structure 19 of the polarizer array 10 or to the support structure of the planar antenna 18. The extremely low mass of the polarizer array elements 12 allow for the use of a very small, low torque drive actuator. Some embodiments may utilize actuators in the form of stepper motors, timing belts, chain drives, gear drives and combinations thereof to support the requisite rotational motion of the polarizer elements 12. The actuator 20 may be driven by control circuitry (not shown) to alter an angular orientation of the polarizers 12.

Although the planar array aperture 18*a* is only "partially" filled (covered), the embodiment shown in FIG. 3*a* nevertheless provides high gain efficiency and good cross-pol isolation characteristics. Theoretically, a perfect circular polarizer embodiment (covering/inscribing 78.5% of a given square uniformly-excited sub-region and employing low-density phase-matching interstitial inserts via 22) yields a theoretical cross-polarization (cross-pol) isolation of −16 dB (2.7 dB Axial Ratio) and a net peak gain loss (due to polarization and directivity losses) of just −0.5 dB. If the planar aperture 18*a* is intentionally tapered in the elevation plane, as is often employed in order to suppress elevation side lobes (and meaning that proportionally less power is present in the (uncovered) interstitial regions as compared to the (covered) polarizer regions, then these loss/cross-pol metrics can improve appreciably to <−0.3 dB net co-polarization (co-pol) gain loss and cross-pol better than −22 dB (1.4 dB AR).

Figure 4:
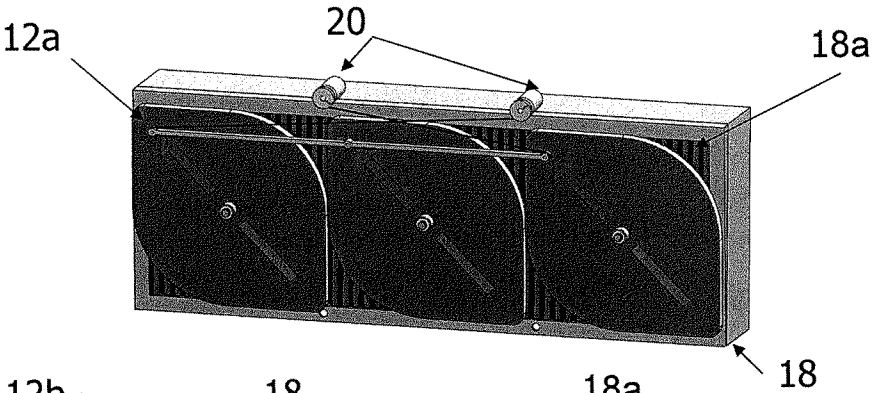
FIG. 4*a* illustrates an inscribed polarizer array employing tear-drop shape polarizer elements.
FIG. 4*b* illustrates an inscribed polarizer array employing over-sized polarizer elements.
FIG. 4*c* illustrates an inscribed polarizer array employing one large polarizing element and two smaller polarizing elements.
Figure 4:
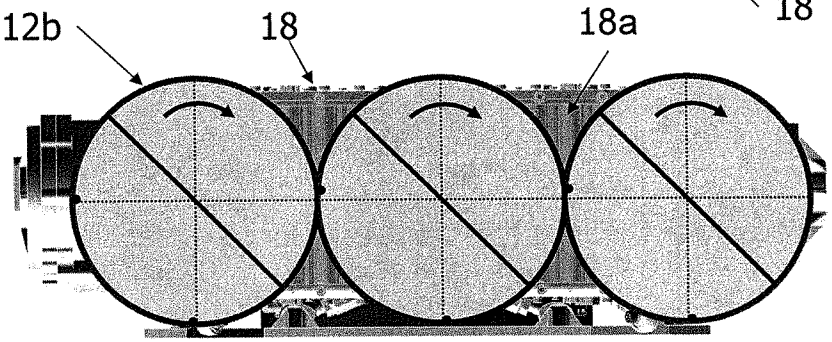
Figure 4:
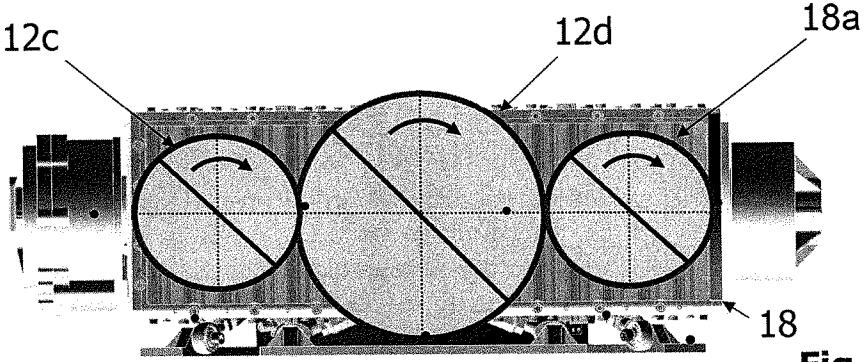

In addition, small increases in the circular polarizer region (e.g., extending some distance outside the circular boundary) can dramatically improve both the co-pol loss and cross-pol isolation characteristics. More particularly, system performance can be enhanced by reducing the area of the aperture that is not within the polarizer region. FIG. 4*a* shows an embodiment in which teardrop shaped polarizer elements 12*a* are used to increase the circular polarizer region, while FIG. 4*b* illustrates an embodiment where over-sized polarizer elements 12*b* are used (e.g., one or more polarizing elements extend outside an area of the antenna aperture). In the embodiments of FIGS. 4*a* and 4*b*, the size (area) of the uncovered regions (i.e., the interstitial regions) between the polarizer elements is reduced, which improves the overall performance (gain efficiency and cross-pol isolation) of the inscribed polarizer array 10.

Often, antennas are tapered in the elevation plane to suppress elevation sidelobes focus more energy in the center of array aperture (less energy impinges on the interstitial regions). FIG. 4*c* illustrates an embodiment that takes advantage of this design characteristic. More particularly, "dissimilar polarizer elements" 12*c* and 12*d* are used (e.g., a larger center polarizer element and smaller polarizer elements arranged adjacent to the larger element, polarizer elements having different dimensions from one another, different surface areas from one another, etc.) and thus the exposed interstitial regions on the outer sections of the array do not have a significant effect on the performance. By increasing the size of the center-most polarizing element 12*d*, the gain and polarization purity are improved. It is noted, however, that if RF energy is uniformly dispersed on the face of the array aperture, then the advantages of the embodiment shown in FIG. 4*c* are less dramatic.

The (rotating) circular polarizers 12 may be in the form of either a "standard" linear-to-CP (circular polarization) polarizer or in the form of a "dichroic" linear-to-CP polarizer. For CP operation, the "trace axes" of a single circular polarizing layer can be oriented at either +/−45 degrees relative to a linear-polarized aperture in order to switch between the desired CP senses. In the case of a tracking-linear variant (e.g., at Ku-Band), a single fixed (rectangular) linear-to-CP polarizer can be affixed to the rectangular radiating aperture 18 and the rotating circular polarizers 12 (CP-to-linear in this case) can be mounted immediately on top of the fixed polarizing layer.

Figure 5:
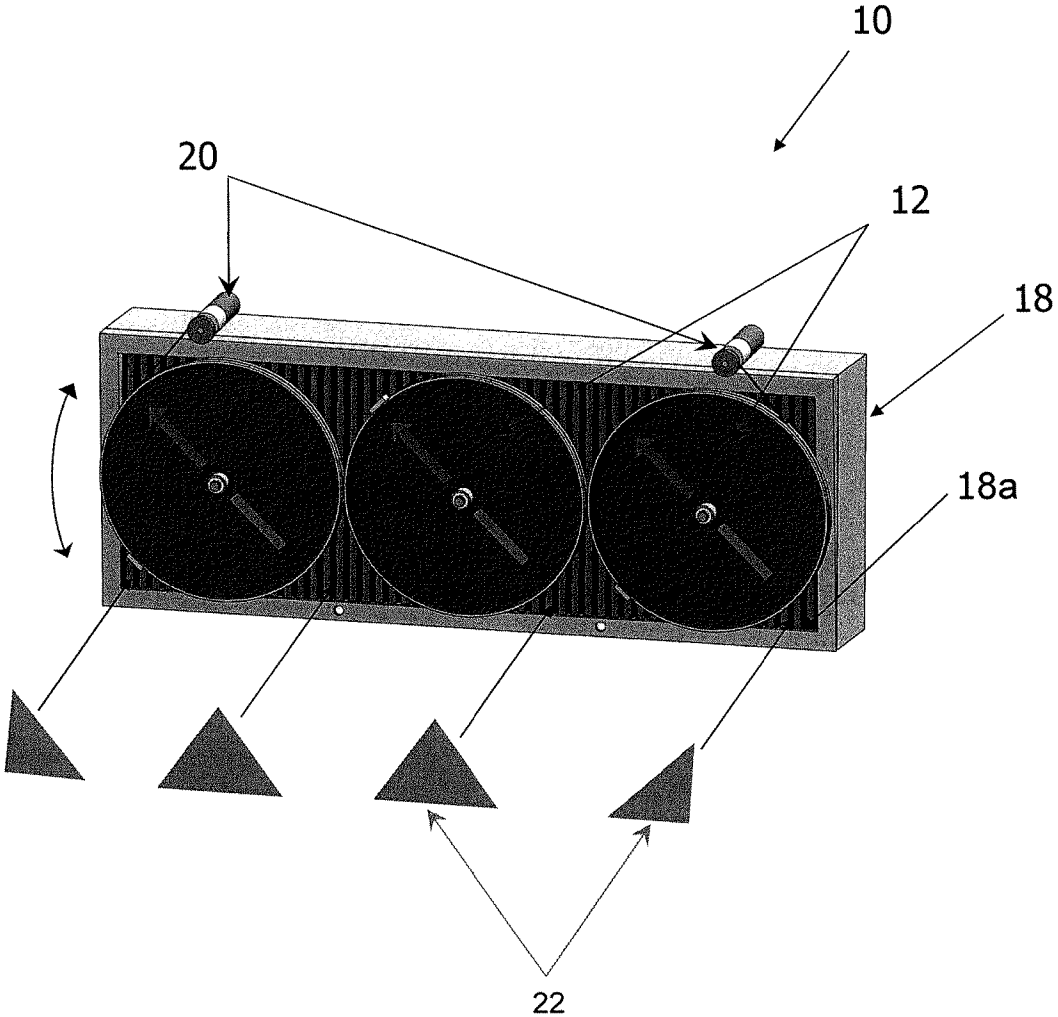
FIG. 5 is a block diagram of an exemplary inscribed polarizer array employing dielectric elements in the interstitial space in accordance with the present disclosure.

With additional reference to FIG. 5, the interstitial (semi-triangular) sections of the planar array 18 that are not covered by the circular shaped polarizers foam can be covered with appropriate low-density inserts 22, e.g., foam elements, meander-line elements, dielectric elements, etc. The addition of the low-density foam 22 and/or meander-line elements in the fixed interstitial regions serves to approximately match the insertion-phase and intermediate polarization of the covered circular regions, thereby providing for improved net coherent gain contributions (for the desired co-polarized signal) from the interstitial regions (albeit at a fixed polarization which only partially matches the desired variable polarization in the covered regions.)

Figure 6:
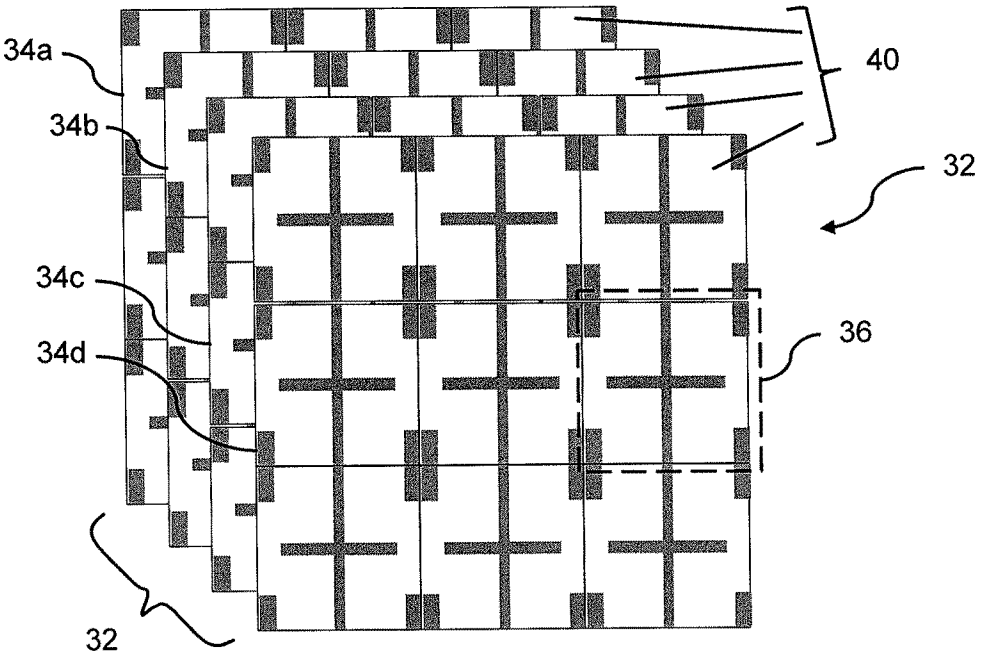
FIG. 6 is an exploded view of an exemplary dual-band dichroic polarizer that may be used in an inscribed polarizer array in accordance with the present disclosure.

With reference to FIG. 6, an exemplary dichroic linear-to-CP polarizer 30 is illustrated that may be used in the inscribed polarizer array 10 in accordance with the present disclosure. The polarizer 30 includes a sheet 32 which includes four stacked layers 34*a*-34*d*, and an array of resonant structures 36 formed on each of the stacked layers 34*a*-34*d*. The resonant structures 36 within the array are preferably identical with respect to those on the same layer 34 as well as those in or on the other layers 34. The resonant structures 36 in or on each layer 34 are aligned with corresponding resonant structures 36 on any overlying or underlying layer 34. Consequently, the sheet 32 is made up of an array of unit cells 40 with each of the unit cells 40 being represented by a corresponding stack of resonant structures 36 formed in or on the respective layers 34.

In the exemplary polarizer 30, each of the layers 34 includes a layer of dielectric material. The resonant structures 36 may be formed of conductive material (e.g., copper) deposited, etched, adhered or otherwise formed on the dielectric material using any conventional technique. The resonant structures 36 may be represented by apertures formed in each of the respective sheets. Assume "m" represents the number of layers 34, and m is an integer equal to or greater than one. Fundamentally, each of the stacked resonant structures 36 in a given unit cell 40 introduces a phase differential of approximately +90°/m to the linearly polarized electromagnetic energy within the first distinct frequency band, with respect to electromagnetic energy which is incident upon and passes through the polarizer 30. Moreover, each of the stacked resonant structures 36 introduces a phase differential of approximately −90°/m to the linearly polarized electromagnetic energy within the second distinct frequency band, with respect to electromagnetic energy incident upon and passing through the polarizer 30. Thus, electromagnetic energy which passes through a given unit cell 40 consisting of m layers 34 will undergo a phase differential of ±90°, depending upon the particular frequency band.

Figure 7B:
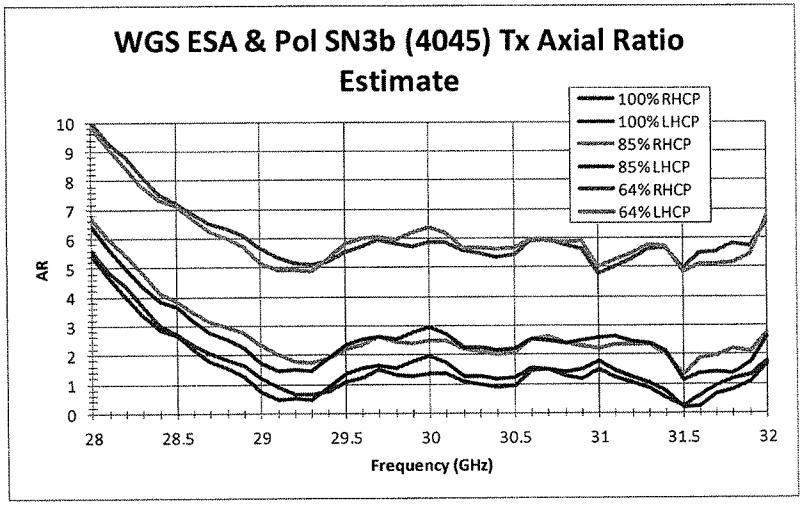
FIGS. 7A and 7B are graphs showing axial ratio performance vs. different aperture coverage.
Figure 7A:
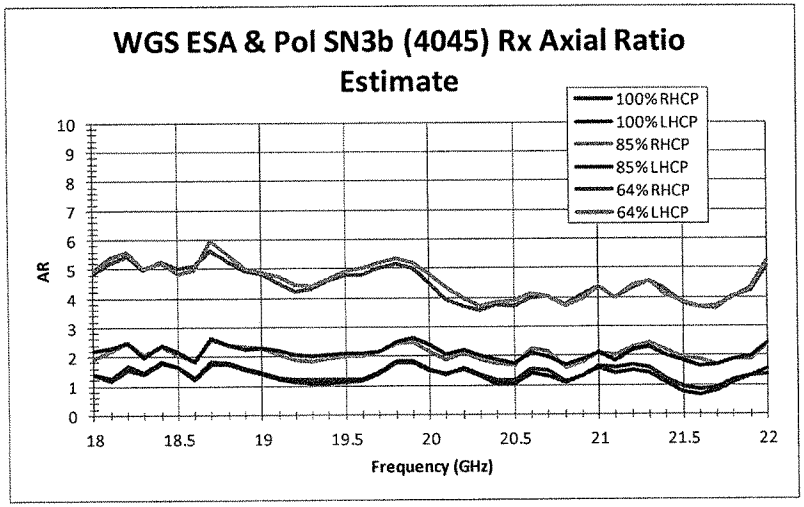
Figure 8A:
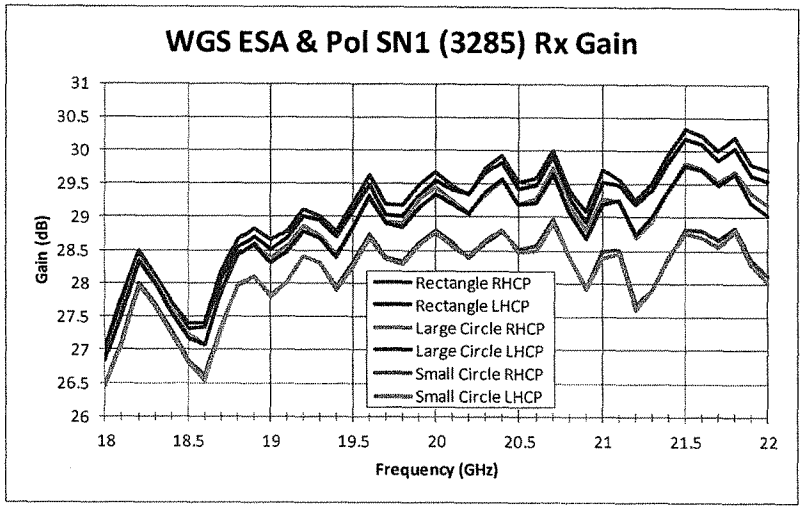
FIGS. 8A and 8B are graphs showing gain performance vs. different aperture coverage.
Figure 8B:
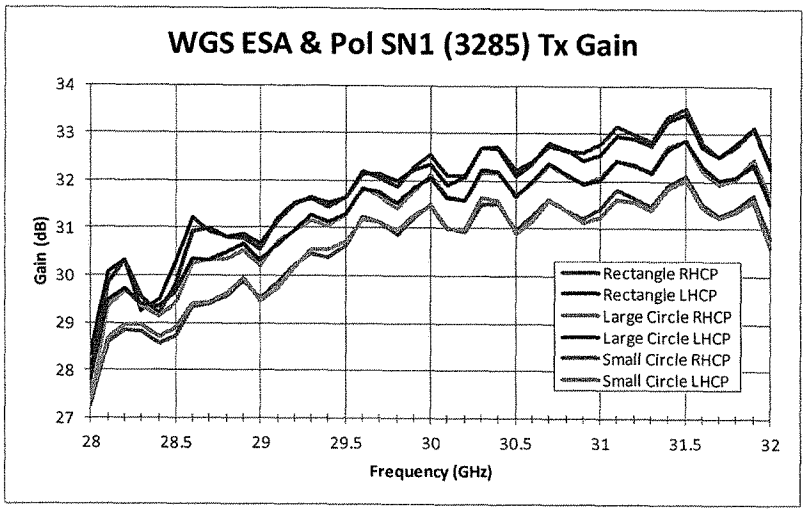

FIGS. 7A/7B and 8A/8B show measured Axial Ratio and measured Gain, respectively, for two different frequency bands of operation, for a planar array with varying amounts of fill for the planar array aperture 18*a* (100%, 85%, and 64%) by the polarizer array 12.

The inscribed polarizer array 10 in accordance with the present disclosure can be installed in front of an antenna array. Since multiple separate polarization paths do not to be carried, such configuration allows use of a simplified corporate feed network behind the array.

The polarizing architecture utilized in the inscribed polarizer array 10 eliminates the need for (and losses associated with) a separate mechanically rotated or electronically rotated OMT to achieve tracking linear polarization as the antenna is moved from one location to another. Additionally, the polarizer architecture eliminates the need for (and losses associated with) a separate polarization switch (for switched Circular Polarization), nor does it have any high-power limits (no power-limiting switches or OMT's). In the case of on-the-move antennas that require elevation and azimuth control, the polarizer architecture eliminates the need to bring multiple waveguide channels (dual band and/or dual pol) across the axes of rotation. Other application examples benefiting from this invention, can include one or more of the following:

1) Simple Fixed Single-Band/Single-Linear planar arrays to Support Tracking-Linear and Switchable Dual-CP operation;

2) Simple Fixed Dual-/Wide-Band/Single-Linear planar arrays to Support Dual-Orthogonal Tracking-Linear and Switchable Dual-Orthogonal CP operation;

3) Fixed Single-Band/Dual-Linear planar arrays to Support Dual-Orthogonal Tracking-Linear; and 4) Fixed Dual-Band/Dual-Linear planar arrays to Support Dual-Orthogonal Dual-Band Tracking-Linear.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

What is claimed is:

1. An antenna system, comprising:

an antenna having an aperture;

a polarizer array comprising a support structure, at least two polarizer elements arranged relative to the support structure, each of the at least two polarizer elements rotatable about a separate axis, and an actuator coupled to the at least two polarizer elements, the actuator operative to effect common rotation of the at least two polarizer elements, wherein the polarizer array is arranged to at least partially cover the antenna aperture; and inserts placed in interstitial regions on the antenna aperture, the inserts configured to match an insertion phase of the at least two polarizers.

2. The antenna system polarizer array according to claim 1, wherein the at least two polarizer elements comprise dissimilar polarizer elements.

3. The polarizer array according to claim 1, wherein the at least two polarizer elements have different dimensions from one another.

4. The polarizer array according to claim 1, wherein an area of one of the at least two polarizer elements is different from an area of another of the at least two polarizer elements.

5. The polarizer array according to claim 1, wherein the at least two polarizer elements comprise circular characteristics.

6. The polarizer array according to claim 1, wherein the at least two polarizer elements comprise a tear drop shape.

7. The polarizer array according to claim 1, wherein the actuator effects ganged mechanical rotation of the at least two polarizer elements.

8. The polarizer array according to claim 1, wherein the actuator comprises at least one of a DC brushless motor, a stepper motor, a timing belt, a chain drive or a gear drive.

9. The polarizer array according to claim 1, wherein the at least two polarizers comprise a linear-to-circular polarization polarizer or a dichroic linear-to-circular polarization polarizer.

10. The polarizer array according to claim 1, wherein the at least two polarizers are configured to effect a switching of one sense of circular polarization to another sense of circular polarization.

11. The polarizer array according to claim 1, wherein the at least two polarizers are configured to effect a twisting of one sense of linear polarization to another sense of linear polarization.

12. The polarizer array according to claim 1, wherein the at least two polarizers comprise a twist polarizer operative to change a linearly-polarized wave polarized in a first direction to a linearly-polarized wave polarized in a second direction different from the first direction.

13. The polarizer array according to claim 1, wherein the at least two polarizers comprise meanderline polarizers operative to convert a polarized wave to a circular polarized wave.

14. The polarizer array according to claim 1, wherein the common rotation comprises synchronized rotation.

15. The polarizer array according to claim 1, further comprising a support structure, wherein the at least two polarizer elements mounted on the support structure.

16. The antenna system according to claim 1, wherein each polarizer element of the at least two polarizer elements is rotatable about a center axis of the respective polarizer element.

17. The antenna system according to claim 1, wherein the antenna comprises a planar antenna.

18. The antenna system according to claim 1, wherein the antenna aperture comprises a prescribed area, and the at least two polarizing elements extend outside the prescribed area.

19. The antenna system according to claim 1, wherein the antenna aperture is tapered in a predetermined plane of the planar antenna.

20. The antenna system according to claim 1, further comprising a transceiver communicatively coupled to the antenna aperture.

21. The antenna system according to claim 1, wherein the at least two polarizers cover at least 83 percent of the surface area of the antenna aperture.

22. The antenna system according to claim 1, wherein the antenna aperture is a non-circular antenna aperture.

23. The antenna system according to claim 1, wherein the antenna aperture is a rectangular antenna aperture.

24. The antenna system according to claim 1, wherein the at least two polarizers are co-planar.

25. An antenna system, comprising:

an antenna including an aperture having a first geometry; and a polarizer array comprising a support structure, at least one polarizer element arranged relative to the support structure, the at least one polarizer element having a second geometry different from the first geometry and rotatable about an axis, and an actuator coupled to the at least one polarizer element, the actuator operative to effect rotation of the at least one polarizer element, wherein the polarizer array is arranged relative to the antenna aperture such that at least a portion of the antenna aperture is uncovered by the at least one polarizer; and inserts placed in the uncovered regions on the antenna aperture, the inserts configured to match an insertion phase of the at least one polarizer element.

26. The polarizer array according to claim 1, wherein the inserts have a triangular shape.

27. The polarizer array according to claim 1, wherein the inserts cover all of the interstitial regions.

* * * * *